United States Patent [19]

Ehring

[11] Patent Number: 4,633,527

[45] Date of Patent: Jan. 6, 1987

[54] MULTILAYERED PROTECTIVE TROUSER ASSEMBLY

[75] Inventor: Carolyn C. Ehring, West Caldwell, N.J.

[73] Assignee: Cairns & Brother, Inc., Clifton, N.J.

[21] Appl. No.: 806,765

[22] Filed: Dec. 9, 1985

[51] Int. Cl.[4] ..... A41D 1/06

[52] U.S. Cl. ..... 2/2; 2/DIG. 6; 2/227

[58] Field of Search ..... 2/2, 227, DIG. 6, 85

[56] References Cited

U.S. PATENT DOCUMENTS

| | | | |
|---|---|---|---|
| 1,271,248 | 7/1918 | Walcoff | 2/227 |
| 1,490,470 | 4/1924 | Laubach | 2/227 |
| 3,111,680 | 11/1963 | Horowitz et al. | 2/227 |
| 4,282,608 | 8/1981 | Amberg | 2/227 |
| 4,302,847 | 12/1981 | Miles | 2/2 |
| 4,507,806 | 4/1985 | Coombs | 2/85 |
| 4,543,670 | 10/1985 | Ehring | 2/85 |
| 4,561,121 | 12/1985 | Ehring et al. | 2/2 |

*Primary Examiner*—Louis K. Rimrodt
*Attorney, Agent, or Firm*—Louis E. Marn

[57] ABSTRACT

There is disclosed a multilayered protective trouser assembly comprised of a station trouser including mounting members and trouser overpants including fastening members for affixing same to the mounting members of the station trouser to provide effective firefighting trouser gear.

15 Claims, 6 Drawing Figures

MULTILAYERED PROTECTIVE TROUSER ASSEMBLY

BACKGROUND OF THE INVENTION

1. Field of the Invention

This invention relates to a multilayered protective trouser assembly, and more particularly relates to a multilayered protective trouser assembly for a firefighter comprising a station trouser and trouser overpants therefor.

2. Description of the Prior Art

Protective outer garments for a firefighter usually includes a heavy protective turnout coat, and some form of upper leg protection to insulate him from the hazards of structural fires. Firefighters are exposed to intense heat, smoke and moisture, and such environmental conditions are compounded by the general character of the ambient weather conditions, i.e. extreme cold or extreme heat. Protective outer garments for a firefighter are primarily designed to shed water and to thermally insulate the firefighter from extraordinary temperatures.

The protective garments worn by a firefighter are generally comprised of an outer shell of extremely tough fabric for protection, a moisture barrier which serves primarily to shed water, and an inner insulating liner. Often times, due to the weight of the assembled garment, the firefighter may remove his inner insulating liners for comfort, and then don his outer protective shell absent the inner insulating liners when called to duty. Such firefighter thereupon has no thermal insulation to protect him from the fire environment and because of the design of the outer protective shell, there is no visual means by which a supervisory officer may easily discern whether or not inner insulating liners are being worn. Additionally, because of the environment in which the firefighter must perform, and the physical activity which he must perform, enormous amounts of moisture are generated by his body which is absorbed in the inner insulating liners. Consequently, if insulating liners are sewn to the outer shell, to prevent the firefighter from removing them as mentioned above, there is no opportunity to change the liner, or to launder and dry same. The firefighter is then required to respond to subsequent fires with only a short duration between a prior firefighting activity; and he finds himself wearing even heavier, moisture saturated inner insulating liners within his protective trousers. Safety is comprised, and the likelihood of stress is increased dramatically due to excess weight in the trousers.

In copending U.S. patent application Ser. No. 06/651,803, filed Sept. 18, 1984, now U.S. Pat. No. 4,561,121 there is disclosed a multilayered protective trouser specifically designed for firefighting activity and compromised of a trouser inner liner including a fly opening and a storm flap folded upon itself to form two layers having fastening means secured thereto, and a trouser outer shell including a fly opening and an outer shell tab having fastening means secured thereto wherein the storm flap extends across both of the fly openings with the outer shell tab removably positioned between the two layers of the storm flap to provide removable attachments between the storm flap and the outer shell tab and provide means for visually determining that the firefighter is properly attired, and specifically with the trouser inner liner.

For the most part, the activities of a firefighter center around the firehouse awaiting firefighting duty, and thus the firefighter is generally clothed in a station uniform or the like. The current invention allows the firefighter to utilize specially designed station uniform trousers in the place of the inner thermally protective liner, thus cutting down on the the weight of the total garment when wearing fully protective clothing.

OBJECTS OF THE INVENTION

An object of the present invention is to provide a novel multilayered protective trouser assembly for firefighting duty comprised of a station trouser and trouser overpants which enable complete assembly of effective firefighting gear without additional weight of thermally protective liners.

Another object of the present invention is to provide a novel multilayered protective trouser assembly for firefighting duty comprised of a station trouser and trouser overpants which enable complete assembly of effective firefighting gear without additional weight of thermally protective liners.

A further object of the present invention is to provide a novel multilayered protective trouser assembly for firefighting duty comprised of a station aesthetically designed for firehouse duty and compatible with trouser overpants for firefighting duty.

Another object of the present invention is to provide a novel multilayered protective trouser assembly for firefighting duty comprised of a station trouser and compatible trouser overpants effective for firefighting activities in which the overpants are rendered unwearable without assembly to specially designed thermally protective station trouser.

Yet another object of the present invention is to provide an outwardly visible means by which components of the full protective trousers can be identified; and which a supervisor on the firegrounds can determine whether or not fully assembled pants are being worn.

SUMMARY OF THE INVENTION

These and other objects of the present invention are achieved by a multilayered protective trouser assembly comprised of a station trouser including mounting members and trouser overpants including fastening members for affixing same to the mounting members of the station trouser to provide effective firefighting trouser gear.

BRIEF DESCRIPTION OF THE DRAWINGS

A better understanding of the present invention as well as the objects and advantages thereof will become apparent upon consideration of the following detailed disclosure thereof, especially when taken with the accompanying drawings, wherein.

DETAILED DESCRIPTION OF THE INVENTION

Figure 1:
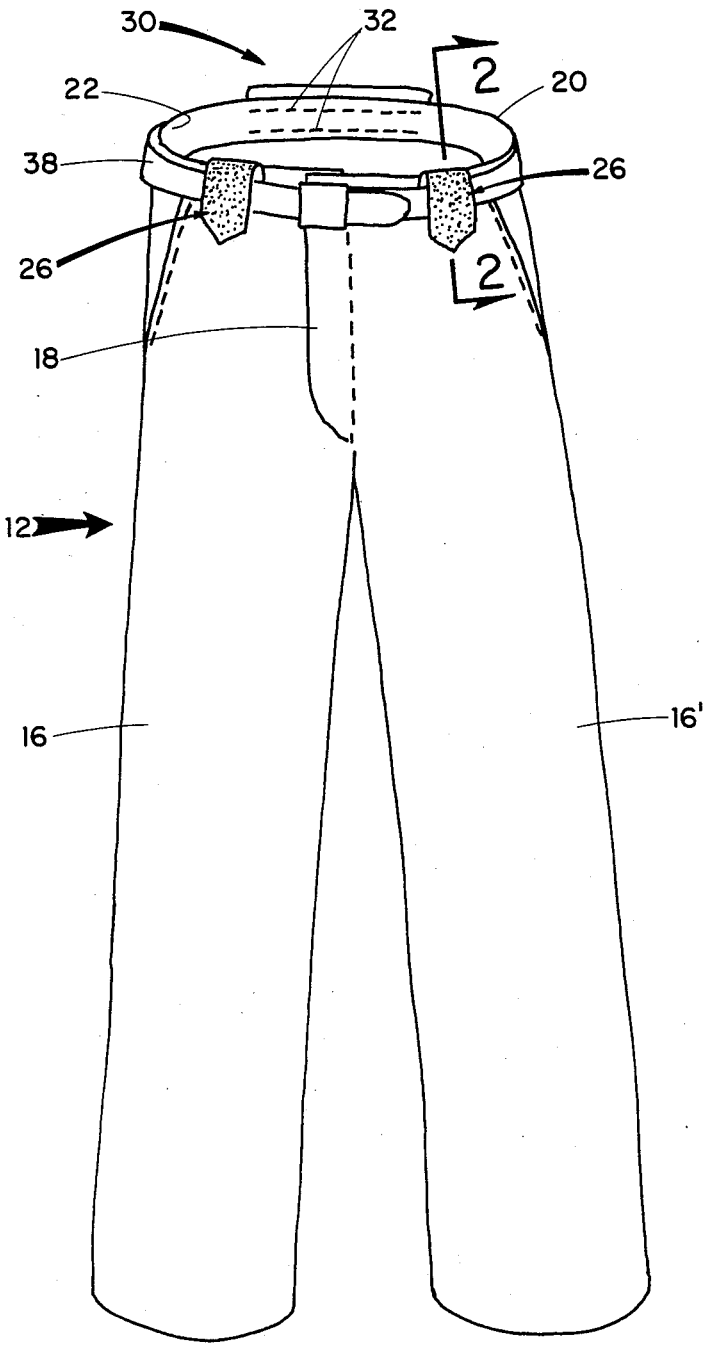
FIG. 1 is a perspective view of a station uniform trouser.
Figure 3:
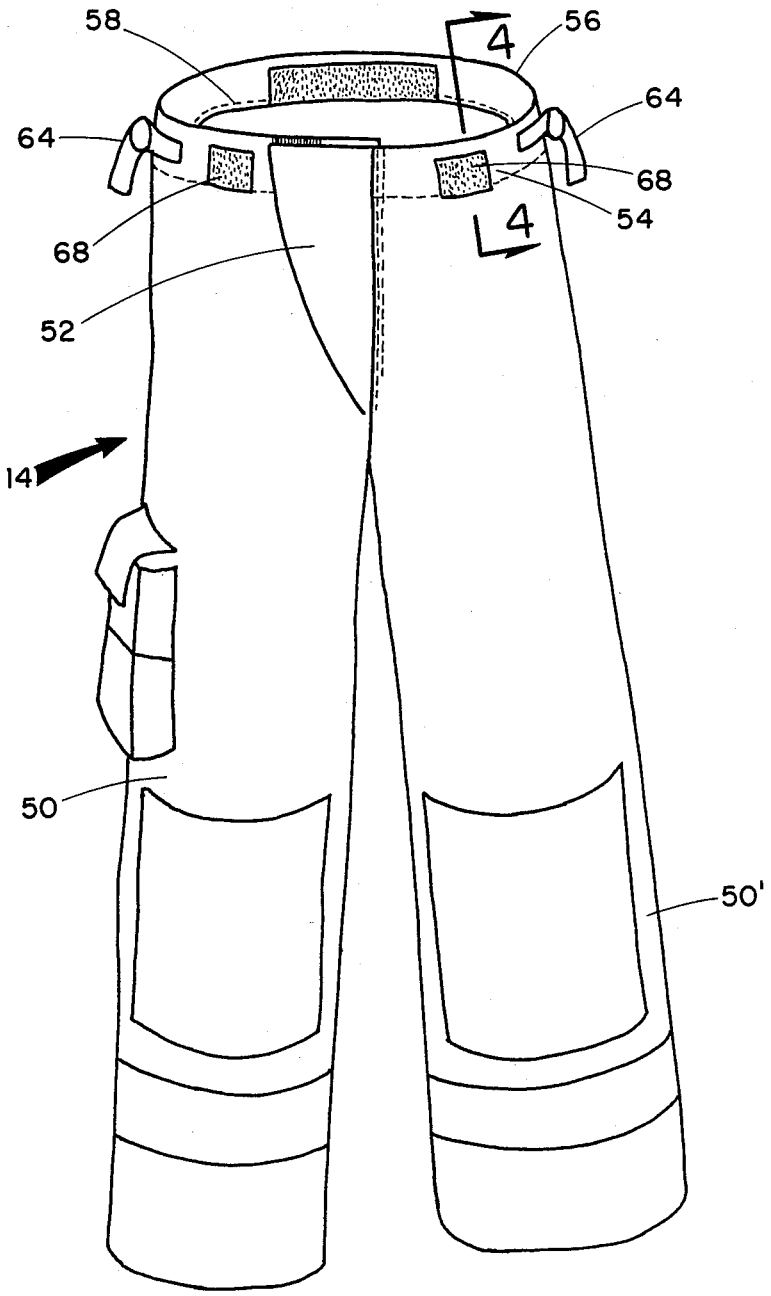
FIG. 3 is a perspective view of trouser overpants for the station uniform trouser depicted in FIG. 1.
Figure 5:
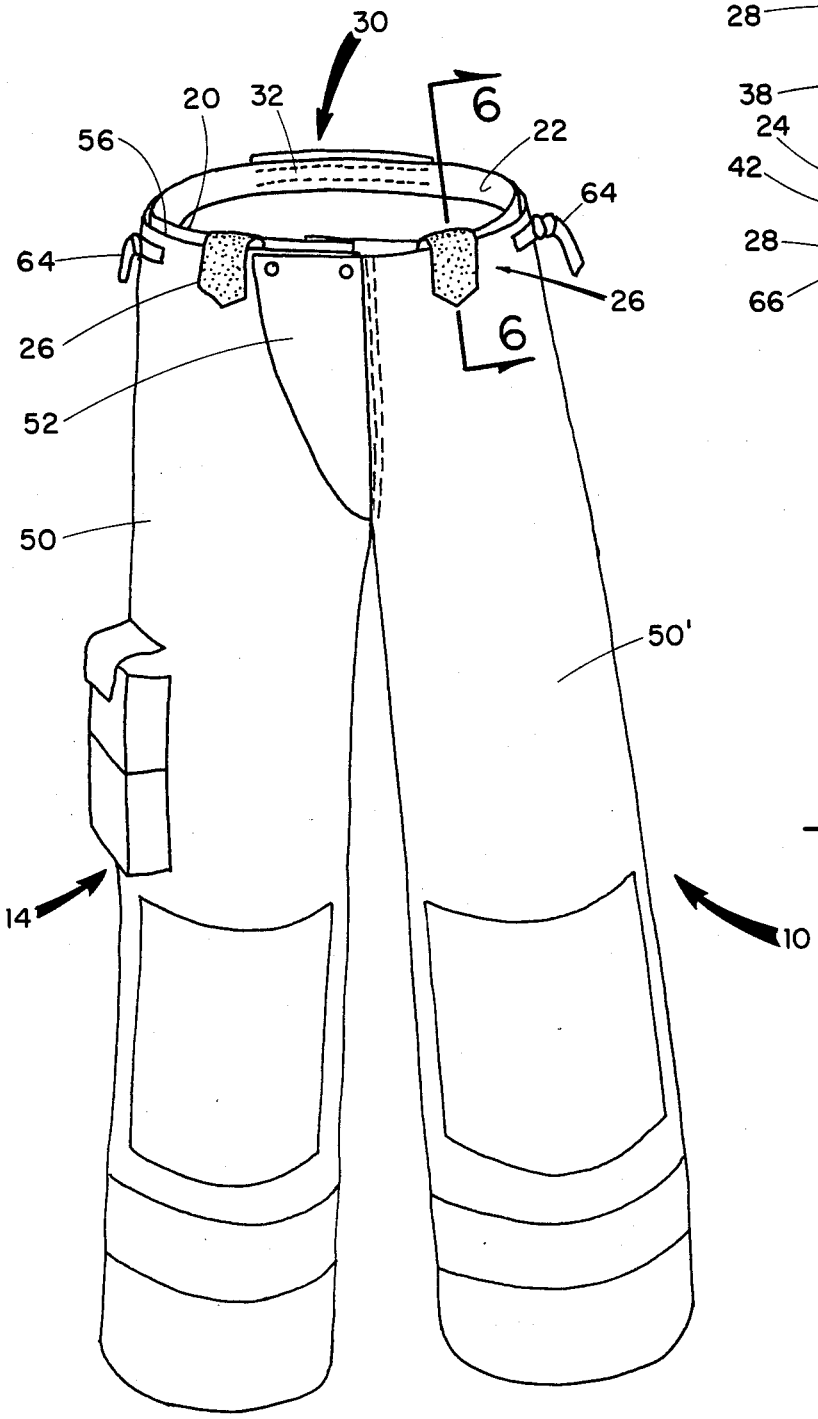
FIG. 5 is a perspective view of an assembled multilayered protective trouser including the station uniform trouser and trouser overpants of FIGS. 1 and 3, respectively.

Referring now to the drawings, and particularly to FIG. 5, there is illustrated a multilayered protective trouser assembly, generally indicated as 10, and comprised of a station trouser and overpants, generally indicated as 12 and 14, referring specifically to FIGS. 1 and 3, respectively. The station trouser 12 and overpants 14 are sized and configured to permit the wearing of the former by the firefighter during station activities, and to permit the wearing of the former with the latter by the firefighter in firefighting duties.

The station trouser 12, referring particularly to FIG. 1, is formed of thermally protective fabric (such as wool or fire-retardant cotton, or Nomex III), and aesthetically designed for station or firehouse activities. The station trouser 12 is capable of acting as a thermal barrier in the multilayered protective trouser assembly 10. The station trouser 12 is formed with a pair of legs 16 and 16', a fly portion 18 and a waist portion 20 circumferentially overlayed by a waist band 22 affixed, such as by sewing at 24 to the top of the waist portion 20 of the station trouser 12. The waist band 22 is generally formed of a like material, such as that of the station trouser 12.

Figure 2:
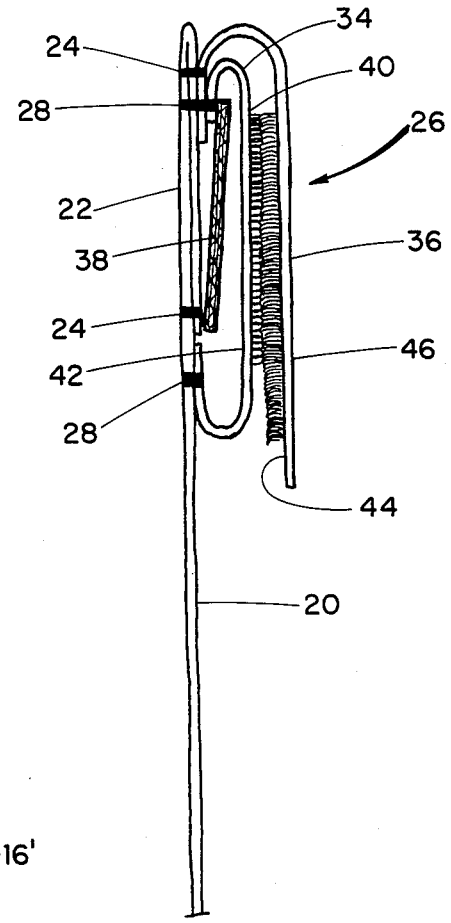
FIG. 2 is an enlarged partial cross-sectional view taken along the lines II—II of FIG. 1.

To the waist portion 20 of the station trouser 12, there is provided on either side of the fly portion 18 in the front of the station trouser 12, a belt loop and mounting assembly made of fabric identical to the station trousers, generally indicated as 26, affixed to the upper waist portion 20, such as by sewing at sewing lines 28, referring also to FIG. 2. To the waist band 22 of the station trouser 12 opposite the fly portion 18, i.e. the back portion of the station trouser 12, there is provided an elongated belt loop and mounting assembly made of fabric identical to the station trousers, generally indicated as 30, affixed, such as by sewing, at sewing lines 32. The belt loop and mounting assemblies 26 and 30 are similarly configured in cross-section with assembly 30 being of greater length than assembly 26.

The belt loop and mounting assemblies 26 and 30 are comprised of an interior belt loop member 34 and an exterior overhanging tab member 36, referring particularly to FIG. 2. The belt loop member 34 defines with the waist portion 20 of the station trouser 12 an elongated oval-shaped opening for positioning and cincturing a belt 38. An outer surface portion 40 of the belt loop member 34 is provided with a fastening element such as one cooperating element of a VELCRO® fastening strip assembly. The tab member 36 includes an inner surface portion 44 which overlies the belt loop member 34 and provided with a fastening element 46, such as a cooperating element of a VELCRO® fastening strip assembly.

In the disclosed embodiment of the present invention herein, reference is made to elements of a VELCRO® fastening assembly, however, it is to be understood by one of ordinary skill in the art that other suitable fastening assemblies may be used without departing from the scope of the present invention. Additionally, as will become hereinafter more fully apparent, the fastening elements 42 and 46 need not be cooperating fastening elements, per se, however, in the interest of aesthetics are preferably cooperating fastening elements.

Figure 4:
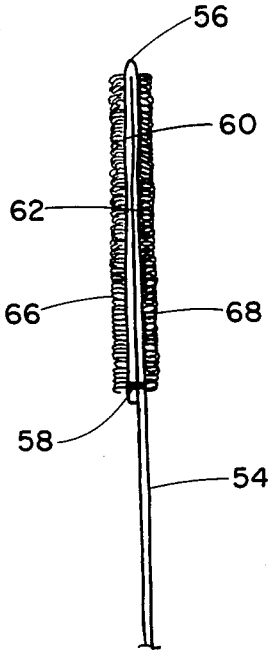
FIG. 4 is an enlarged partial cross-sectional view taken along the lines IV—IV of FIG. 3.

The outerpants 14 for the station trouser 12, referring now to FIGS. 3 and 4, are formed of damage-resistant material for providing fire protection and is formed by a pair of legs 50 and 50', a fly portion 52 and a waist portion 54 circumferentially formed with a seamed waist band 56 having inner and outer surfaces 60 and 62, such as by sewing, at sewing lines 58. The waist band 56, on side portions thereof, is provided with waist band assemblies 64 for convenient cincturing as will become more fully hereinafter apparent. To the waist band 56 and the inner and outer surfaces 60 and 62 and in areas thereof corresponding to the belt and mounting assemblies 26 and 30 of the station trouser 12, there are provided fastening elements 66 and 68, respectively, such as fastening elements of a VELCRO® fastening strip assembly, referring now particularly to FIG. 4, cooperating with the fastening elements 42 and 46 of the station trouser 12.

In use and performing station duty, the firefighter is wearing, inter alia, the station trouser 12, generally with the fastening elements 46 of the tab members 36 in cooperative engagement with the fastening elements 42 of the belt loop and mounting assemblies 26 and 30. Upon a call to duty, the firefighther dons the overpants and lifts same to a position slightly below the belt loop and mounting assembly 26. The tabs 36 are lifted and/or pulled away from the front belt loops 34 by disengagement of the fastening elements 46 thereof from the fastening elements 42 of the belt loops 34 whreeupon the front portion of the waist band 56 is inserted therebetween with the fastening elements 66 and 68 thereof aligned with respect to the fastening elements 42 and 46. Upon appropriate alignment, the tab members 36 are pressed into the body of the firefighter thereby causing interlocking fastening or cooperation between the fastening elements 42 and 66, and 46 and 68, of the belt loop members 34 and tab members 36 of the station trouser 12 with respect to the waist band 56 of the overpants 14 as illustrated in FIG. 6.

Figure 6:
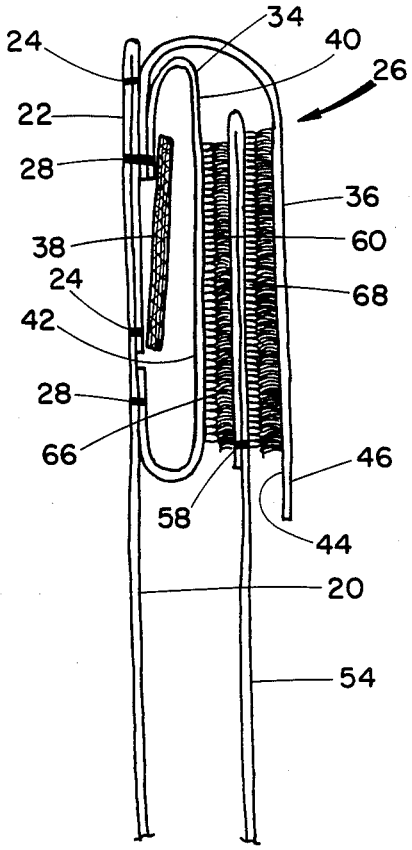
FIG. 6 is an enlarged cross-sectioanl view taken along the line VI—VI of FIG. 5.

Thereupon, the tab member 36 of the rear belt loop and mounting member 30 is similarly disengaged from the belt loop member 34 and a rear portion of the waist band 56 including fastening elements 66 and 68 of the overpants 14 inserted therebetween whereupon the tab members 36 are similarly pressed against or into the back of the firefighter to similarly cause engagement between fastening elements 42 and 66, and 46 and 68, as illustrated in FIG. 6. To provide additional waist fitting of the overpants 14 about the waist of the firefighter, waist band assemblies 64 are generally cinctured after assembly of the gear. It will be appreciated by one skilled in the art that the assemblies 26 and 30 provide an indication to supervisory firefighting personnel that the firefighter is clothed with a station trouser beneath the overpants, and thus a fully protective trouser assembly.

While the present invention has been described with reference to a cincturing belt assembly including belt loops to receive a belt for maintaining the station trouser on the firefighter, the station trouser may be provided with a suspender type assembly, such as described in the aforementioned copending application, concomitantly with modified mounting assembly for positioning the overpants. Additionally, it will be understood that the assembly will be formed of a material configuration to provide the moisture and thermal barriers as also disclosed in such copending application.

What is claimed:

1. A multilayered protective trouser assembly for a user, which comprises:

a station trouser specially designed for said user including a waist portion and formed of a thermally protective fabric;

tab members overlying said waist portion of said station trouser, said tab means provided with a first fastening element;

overpants positioned about said station trouser formed of a material to provide direct flame protection and including a waist portion; and second fastening elements positioned about said waist portion of said overpants, said second fastening elements cooperating with said first fastening elements to mount and maintain said overpants with respect to said station trouser whereby in cooperative mounted relationship between said fastening elements said tab members provide a visual indication of the presence of said station trouser in said assembly.

2. The multilayered protective trouser assembly as defined in claim 1 wherein said second fastening elements are mounted about an outer surface of said waist portion of said overpants and said first fastening elements of said tab members are mounted on an inner surface thereof.

3. The multilayered protective trouser assembly as defined in claim 2 wherein said station trousers are provided with belt loop members disposed beneath said tab members.

4. The multilayered protective trouser assembly as defined in claim 3 wherein an outer surface of said belt loop members are provided with fastening elements.

5. The multilayered protective trouser assembly as defined in claim 4 wherein said fastening elements of said belt loop members cooperate in mounting relationship to said first fastening elements of said tab members.

6. The multilayered protective trouser assembly as defined in claim 5 wherein said fastening elements are mounted to an inner surface of said waist portion of said overpants and cooperate with said fastening elements of said tab members.

7. The multilayered protective trouser assembly as defined in claim 1 wherein said tab members are provided in front and back sections of said station trouser.

8. the multilayered protective trouser assembly as defined in claim 7 wherein a tab member is provided on either side of a fly portion of said station trouser.

9. The multilayered protective trouser assembly as defined in claim 8 wherein said tab member mounted to said back section of said waist portion is elongated with respect to said tab members mounted to said front section.

10. The multilayered protective trouser assembly as defined in claim 1 wherein said overpants include a moisture barrier.

11. The multilayered protective trouser assembly as defined in claim 1 wherein said fastening elements are of a cooperating hook material to a loop material.

12. The multilayered protective trouser assembly as defined in claim 1 wherein said station trousers are provided with belt loop members disposed beneath said tab members.

13. The multilayered protective trouser assembly as defined in claim 12 wherein an outer surface of said belt loop members is provided with fastening elements.

14. The multilayered protective trouser assembly as defined in claim 13 wherein said fastening elements of said belt loop members cooperate in mounting relationship to said first fastening elements of said tab members.

15. The multilayered protective trouser assembly as defined in claim 13 wherein said fastening elements are mounted to an inner surface of said waist portion of said overpants and cooperate with said fastening elements of said tab members.

* * * * *